US009267247B2

(12) United States Patent
Angel

(10) Patent No.: US 9,267,247 B2
(45) Date of Patent: Feb. 23, 2016

(54) ERGONOMIC NON-MOTORIZED VIBRATORY CONCRETE SCREED

(71) Applicant: Jeff R. Angel, Mt. Vernon, IN (US)

(72) Inventor: Jeff R. Angel, Mt. Vernon, IN (US)

( * ) Notice: Subject to any disclaimer, the term of this patent is extended or adjusted under 35 U.S.C. 154(b) by 0 days.

(21) Appl. No.: 14/244,533

(22) Filed: Apr. 3, 2014

(65) Prior Publication Data

US 2015/0284917 A1 Oct. 8, 2015

(51) Int. Cl.

| | |
|---|---|
| ***E01C 19/22*** | (2006.01) |
| ***E01C 19/40*** | (2006.01) |
| ***E04F 21/24*** | (2006.01) |
| ***E04G 21/06*** | (2006.01) |

(52) U.S. Cl.

CPC ..... *E01C 19/402* (2013.01); *E04F 21/242* (2013.01); *E04G 21/066* (2013.01)

(58) Field of Classification Search

CPC ..... E01C 19/44; E01C 19/402; E04F 21/02; E04G 21/066

USPC ..... 404/93, 118, 97; 15/235.4

See application file for complete search history.

(56) References Cited

U.S. PATENT DOCUMENTS

| | | | | |
|---|---|---|---|---|
| 867,852 | A | 10/1907 | Switzer | |
| 3,883,259 | A | 5/1975 | Berg et al. | |
| 4,213,749 | A | 7/1980 | Morrison | |
| 4,349,295 | A | 9/1982 | Morrison | |
| 4,349,328 | A | 9/1982 | Allen | |
| 4,397,581 | A | 8/1983 | Jarvis | |
| 4,466,757 | A | 8/1984 | Allen | |
| 4,577,994 | A | 3/1986 | Miller | |
| 4,723,869 | A | 2/1988 | Dragich | |
| 5,115,536 | A * | 5/1992 | Jarvis | 15/235.8 |
| 5,234,283 | A | 8/1993 | Adkins | |
| 5,244,305 | A | 9/1993 | Lindley | |
| 5,281,050 | A * | 1/1994 | Howard | 404/120 |
| 5,375,942 | A * | 12/1994 | Lindley et al. | 404/97 |
| 5,540,519 | A | 7/1996 | Weber | |
| 5,549,413 | A | 8/1996 | Bolden | |
| 5,727,279 | A | 3/1998 | Pike, Jr. | |
| 5,857,803 | A | 1/1999 | Davis et al. | |
| 5,980,154 | A | 11/1999 | Record | |
| 5,984,571 | A | 11/1999 | Owens | |
| 6,379,080 | B1 | 4/2002 | Saffo, Sr. | |
| 6,779,945 | B2 | 8/2004 | Saffo, Sr. | |
| 6,923,595 | B1 * | 8/2005 | Chek | 404/118 |
| 6,953,304 | B2 | 10/2005 | Quenzi et al. | |
| 7,121,762 | B2 | 10/2006 | Quenzi et al. | |
| 7,175,365 | B1 * | 2/2007 | Breeding | 404/113 |
| 8,277,144 | B1 * | 10/2012 | Bayley | 404/75 |
| 2003/0031510 | A1 * | 2/2003 | Suriano | 404/118 |
| 2006/0257207 | A1 | 11/2006 | Face, III et al. | |
| 2011/0299924 | A1 * | 12/2011 | Stephens | 404/75 |

* cited by examiner

*Primary Examiner* — Raymond W Addie
(74) *Attorney, Agent, or Firm* — C. Richard Martin

(57) ABSTRACT

An ergonomic non-motorized vibratory concrete screed is provided that is designed to be used in the fashion of a standing one-man wet screed having a double barred, floating strike plate oriented in a planar fashion with which to strike and consolidate a concrete slab surface. The vibratory concrete leveling device according to the invention includes a bracket assembly having an upper surface and a lower surface. The lower surface of the bracket assembly includes a plurality of spaced apart slots, each spaced apart slot extending across a width of the bracket assembly. A corresponding plurality of screed bars are removably positioned in the plurality of spaced apart slots. Each of the plurality of screed bars are loosely fitted into each corresponding slot to promote vibratory action during use. An elongated handle is provided having a first end attached to the bracket assembly and a second end for grasping by a user.

16 Claims, 4 Drawing Sheets

ERGONOMIC NON-MOTORIZED VIBRATORY CONCRETE SCREED

FIELD OF THE INVENTION

This application relates to concrete work, specifically striking, screeding and floating horizontal concrete surfaces.

BACKGROUND OF THE INVENTION

When a concrete contractor is asked to pour a sidewalk, concrete pad, or floor, once the plastic concrete has been poured into its forms and raked level, the contractor must produce a flat, uniform surface that is structurally sound and satisfactory to the customer.

Concrete "flatwork" is a universal process where, first, the concrete contractor pours plastic concrete into forms, then levels the plastic concrete using hand labor. Hand labor is used to place and roughly level the plastic concrete using tools called come-alongs or rakes. The next step is called "striking" the concrete. Concrete is "struck" using a screed; it is given a flat, level surface using a horizontally-aligned bar of some type to pull and level the freshly poured plastic concrete surface into a plane.

Traditionally, striking can be achieved using two different approaches dictated by availability of tools, labor, and the individual preference of the concrete contractor. Screed bars and motorized vibratory screeds are the two choices for striking concrete.

1. Screed bars: 2×4 s aligned horizontally and used in planar fashion with the 2" surface contacting the concrete and worker(s) gripping the 4"surface vertically.
   a. A 2×4 screed bar of wood or metal and sized to the specific job is typically used by a team of 2 workers who grip the 2×4 and drag the plastic concrete into a level surface within forms. A screed bar can also be used by a single individual, but productivity is decreased as compared to that of a two-person team due to the increased physical effort required. The screed bar is used to screed and strike, using multiple lifting and dragging motions to smooth and level the plastic concrete within the forms. In this non-motorized process, individuals hold directly onto the screed bar 2×4 in a stooped posture, manually moving the screed bar. Using screed bars in this fashion is a common source of back and or arm strain or injury. There are tools which have been created which aid the operator of the 2×4 screed bar in holding onto it either in stooped postures or standing postures.
   b. Vice-like attachments with handles allow the strikers using the stoop and drag method to hold onto the bar with less difficulty.
   c. Long-handled attachments can be employed to allow the individuals to stand upright and drag the 2×4 screed bar across the concrete in the striking process. This piece of equipment is called a "standing screed".
2. Vibratory, motorized, manual standing screeds have been invented to introduce vibration into the screed bar to increase the standing screed's effectiveness. It vibrates the concrete to strike it quickly into a flat surface. Motorized vibratory screeds employ an attached motor to induce vibration to smooth and level the plastic concrete and increase the strength of the finished concrete with the increased consolidation of the aggregate obtained by vibration; (lasers are sometimes utilized on motorized screeds to aid the operator in obtaining a level surface). Some motorized vibratory screeds exist that require forms, some, only a wet bench (floating screeds), and some, which utilize lasers, require no "bench" to rest upon to produce the desired product. Motorized vibratory screeds of any type are highly technical pieces of equipment, which are costly, heavy, and require working technical knowledge of the specific tool used.

The present invention revolutionizes the non-motorized screeding and striking process in a simple harmonization of physics and ergonomics. Before describing the present invention, the disadvantages of the above-described concrete screeding and striking processes will be discussed.

The traditional manual screeding technique described above is laborious, and frustrating at times, as well. The hand-held 2×4 is cheap and easy to transport, requires little maintenance or repair, but requires a skilled worker or workers working in tandem with each other with an almost mind-reading quality to work in a rhythm in order to obtain an acceptable concrete surface. These concrete workers must also have exceedingly high abilities to protect their necks, arms and backs from injury due to the awkward positioning and repetitive movements required to strike the concrete in this way.

Standing improves the operator's ergonomics but the device can only screed the concrete without the ability to introduce vibration into the concrete without the addition of a motor strapped to the device.

The motorized floating vibratory screed is expensive, often highly technical, and heavy.

Transportation of large screeds for larger pours becomes an issue for a small-business contractor who often operates with a skeleton crew. The expense of moving a heavy, unwieldy piece of equipment like a motorized screed must be considered. Larger vehicles with winch capabilities increase cost. The process of loading the equipment is a safety concern, as well. Electronic equipment requires expensive repairs and oftentimes, extensive down time. Motors require fuel, oil and maintenance. The time and monetary cost of training employees to learn the proper operation of the instrument also must be considered. All of these factors can greatly increase frustration and decrease productivity if any one fails at any given time.

It is an object of the present invention to provide an ergonomic non-motorized vibratory concrete screed that can be wielded by a single person in order to achieve a superior concrete surface with the least amount of stress to the body and the highest amount of satisfaction to the customer.

The present invention is a small, disassemble-able device that can be built inexpensively, transported easily, used by one man to provide excellent results in projects ranging from sidewalks to driveways to basement floors and patios. Basically, the present invention is designed primarily for residential to small commercial concrete work. By changing attachments it can be modified into a two-person-operated device for larger pours, if desired.

The present invention differs from the previously discussed screeding and striking devices in that its screeding surface is not a single bar, but a floating double bar screeding-striking "plate". Its screeding-striking plate is not a single vertically aligned bar as used in the manual screeding described above, but double bars oriented in a planar fashion. It is this screeding-striking plate with double 4" surfaces which is in contact with the concrete, not a 2" wide screed bar surface as described in the previous standing screed devices. This design allows the screeding-striking plate surface to physically modify concrete by screeding and also introduces vibration accomplished by intermittent pulls on the handle which rock and slide the planar bars over the wet concrete.

As the leading screed bar of the floating strike plate contacts the plastic concrete surface and begins the leveling process (the operator proceeds to make repetitive short, sharp pulls while walking slowly backward) the second plate catches the surface and "finishes" the leveling process. Working as a unit, double screed bar plate of the present invention allows 2 bars to act in tandem, producing vibration similar to a motorized vibrating screeding device. The plastic concrete is vibrated and, therefore, its mass is consolidated while its surface is leveled.

The operator of the present invention is subjected to a very manageable amount of physical exertion as the operator's position is standing, and the action is one of pulling on handles extending from the screed plate assembly at waist level. The base plates of the screed plate assembly have adjustable 45° angle connections. This allows the operator to hold a U-shaped handle at a comfortable waist-level height while making short, repetitive pulling motions generated with minimal effort. By using multiple major muscle groups, legs, abdominals, thoracic, back and arm muscles, no one single group of muscles is overtaxed. A superior surface and concrete strength is achieved with a satisfactory ease of tool use.

It is a further object of the present invention to provide an ergonomic that is easily assembled, transported and stored and is light-weight.

A further object of the invention is to provide an ergonomic non-motorized vibratory concrete screed that may be easily modified to suit the size of any concrete pour.

Yet another object of the present invention to provide an ergonomic non-motorized vibratory concrete screed that is economical, due to simple and easily interchangeable parts without need for power tools to do so.

A further object of the present invention to provide an ergonomic non-motorized vibratory concrete screed that can be used in combination with screed equipment possibly already owned by the contractor.

A still further object of the present invention to provide an ergonomic non-motorized vibratory concrete screed that is ergonomic, not fatiguing a single muscle group in isolation.

Another further object of the present invention to provide an ergonomic that lays very flat, uniform concrete due to the total area of floating strike-plates on contact with the plastic concrete during use and vibration.

A further object of the present invention to provide an ergonomic non-motorized vibratory concrete screed that does not require a motor and is low maintenance.

A further object of the present invention to provide an ergonomic non-motorized vibratory concrete screed that floats on a "wet bench" requiring less form work.

SUMMARY OF THE INVENTION

According to one presently preferred embodiment, an ergonomic, floating, screeding, concrete-striking tool is provided that utilizes two screed bars bracketed together into a screed plate assembly, employing a waist-level U-shaped handle attached to the brackets at a 45 degree angle, adjustable to the operator's comfort. It is pulled across just poured, plastic concrete by an operator using short and repetitive pulling motions. The screed plate assembly surface, when properly used, produces a highly satisfactory, flat surface with no need for attached motorized vibration and with an ergonomic design that decreases physical stress on the operator to healthy levels when compared to the traditional stoop and drag 2×4 method. This tool does away with stooped striking altogether. This tool also does away with part of the form boards needed when using a single-bar standing screed that merely pulls concrete into a level surface. With the present invention, forms are not required on both sides of the striking surface; it "floats" on a "wet bench". It creates very strong concrete because of operator-induced vibration which is increased in magnitude by the action of the double bar screed plate assembly. When the leading screed bar of the screed-plate assembly contacts the plastic concrete and is pulled, it creates a hydraulic change in the plastic concrete by compressing and forcing it down under the first screed bar and upward between the screed bars. As the short, repetitive pulls continue, the following screed bar of the screed plate assembly is able to cut, level, vibrate and consolidate the concrete a second time. This tool is simple to assemble and disassemble, store and maintain and is economical. It can be easily modified in size to accommodate the size of the concrete pour and be used by one man or a team. It also may eliminate the necessity for the magnesium floating process traditionally employed after screeding which pulls the fine granules of the concrete aggregate to the top, as this is already accomplished by the following edge of the double-barred strike plate of the present invention.

According to one aspect of the present invention, there is provided a vibratory concrete leveling device comprising a bracket assembly having an upper surface and a lower surface. The lower surface of the bracket assembly includes a plurality of spaced apart slots, each spaced apart slot extending across a width of the bracket assembly. A plurality of screed bars corresponding to and positioned in the plurality of spaced apart slots are also provided. Each of the plurality of screed bars are loosely fitted into each corresponding slot to promote vibratory action during use. An elongated handle is also provided having a first end attached to the bracket assembly and a second end for grasping by a user. The width of each of the plurality of spaced apart slots is greater than the width of each of the corresponding plurality of screed bars.

According to a further aspect of the invention, means for adjusting the fit of each of the screed bars in the corresponding slot are provided. Means for removably securing each of the plurality of screed bars in the corresponding plurality of slots are also provided. The means for adjusting the fit and means for removably securing may include a fastener which passes through aligned openings in each of the plurality of screed bars and in aligned openings in the bracket assembly. The fastener may be a bolt having a head on a first end thereof and a threaded portion extending from a second end thereof for receiving a nut thereon.

According to a further aspect of the invention, the bracket assembly is comprised of an upper bracket and a lower bracket. The upper bracket includes a substantially flat, planar member with a leading edge flange extending downwardly from a first end thereof and a following edge flange extending downwardly from a second end thereof. The lower bracket similarly includes a substantially flat, planar member with a leading edge flange extending downwardly from a first end thereof and a following edge flange extending downwardly from a second end thereof. The lower bracket has a width that is less then a width of the upper bracket.

The lower bracket may be positioned between the leading edge flange and following edge flange of the upper bracket such that a first one of said plurality of slots is defined by the leading edge flange of the upper bracket and the leading edge flange of the lower bracket. A second one of the plurality of slots is defined by the following edge flange of the upper bracket and the following edge flange of the lower bracket. Each one of the upper bracket leading edge flange, lower bracket leading edge flange, lower bracket following edge flange and upper bracket leading edge flange includes a hole therein. Each hole in each respective flange is in alignment with the holes in the other flanges. Each of the screed bars further including a hole therein, which, when the screed bars are properly positioned in the slots, are in alignment with the openings in the respective flanges. The device further including an elongated fastener extending through the holes in the flanges and the holes in the screed bars for removably securing the screed bars to the bracket assembly. The elongated fastener may be a bolt having a head at a first end thereof, a length extending through said holes in said flanges and said screed bars, and a threaded portion along the length proximal to a second end thereof. A nut threadably engaging the threaded second end of the bolt may be provided to secure things in place and provide for adjustability. The head of the bolt engages the upper bracket leading edge flange at the hole therein. When threaded into position, the nut releasably engages the upper bracket following edge flange at the hole therein. The fit of each of the screed bars in the corresponding slot is adjusted by tightening the nut on the bolt.

According to another aspect of the invention the vibratory concrete leveling device may further include a bull-float bracket mounted on an upper surface of the bracket assembly. The first end of the elongated handle is connected to the bull-float bracket.

Yet a further aspect of the invention includes providing the vibratory concrete leveling device with a second bracket assembly having an upper surface and a lower surface. The lower surface of the second bracket assembly includes a plurality of spaced apart slots, each spaced apart slot extending across a width of the bracket assembly for receiving a corresponding one of the plurality of screed bars. A first bull-float bracket may be mounted on an upper surface of the first bracket assembly, and a second bull-float bracket may be mounted on an upper surface of the second bracket assembly. In this configuration, the elongated handle may be a u-shaped handle having a first end connected to the first bull-float bracket and a second end connected to the second bull-float bracket. The u-shaped handle may include a plurality of segmented tubing section that can be assembled to form the u-shaped handle.

DETAILED DESCRIPTION OF PREFERRED EMBODIMENTS

Figure 1:
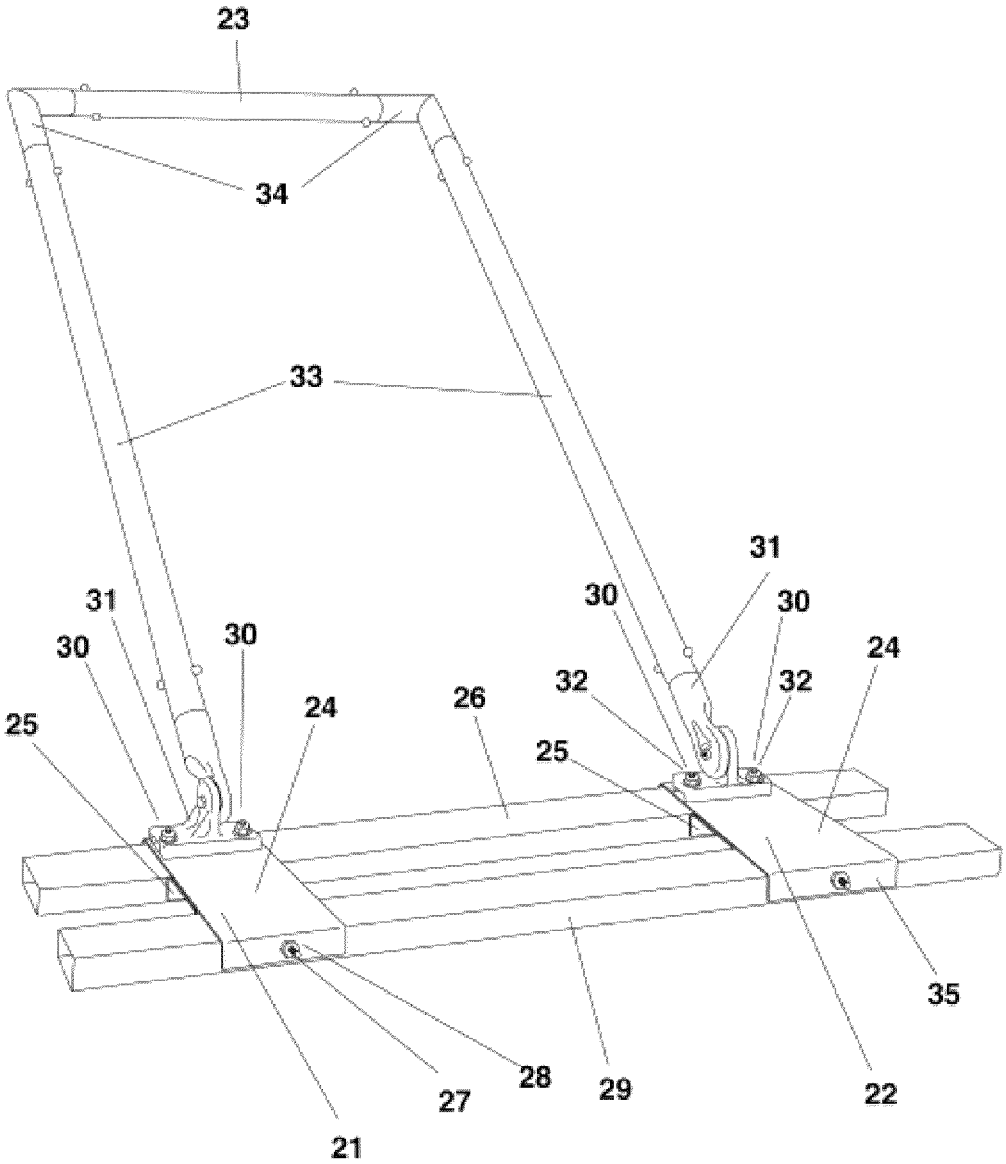
FIG. 1 is a perspective view of an ergonomic non-motorized vibratory concrete screed according to one presently preferred embodiment of the invention.

One presently preferred embodiment of the invention is illustrated in FIG. 1. The powerful effects of this simple screed originate in the floating screed plate assembly which is comprised of two screed bars linked by a bracket system. There is a right 21, and a left 22, bracket assembly. These brackets are designed for the attachment of the handle 33, for the operator and attachments of the floating screed plate assembly that contacts the concrete. Each bracket assembly comprises two separate metal components: an inverted U-shaped upper bracket 24, and an inverted U-shaped lower bracket 25. The right and left upper brackets 24, are 8"×13" and made of light-gauge metal. The right and left lower brackets, 25, are 8"×5" with both front and rear downward L-bends of 90°, hereafter, "flanges" being 8"×1⅜" on surface. When assembled, this bracket assembly provides two spaces: one space for the leading and one space for the following planar-oriented 2"×4" strike bars of the floating screed plate assembly. On the leading edge of the upper brackets 24, is a downward turning 90° angle, creating the 8"×1⅜" front flange surface. This leading face L-bend is designed for the attachment of the leading floating screed bar 26. In the middle of this leading face on each bracket is a hole through which a 14" bolt 27, passes and is secured by a nut 28. These bolts secure both floating screed bars to the bracket. The following floating screed bar 29, is attached to the bracket via the same 14-inch bolt. Two smaller bolts 30, extend vertically up through the assembled bracket to secure a standard, adjustable, two-hole button-socketed, standard bull-float bracket 31 to the top of the upper bracket assembly portions 24 with washers and nuts 32. These two-hole button handle standard bull-float brackets are readily available from concrete supply resources and are designed to accept two-hole button handles which help to form the U-shaped handle, used by the operator to guide the device.

The 14" attachment bolt 27 that runs through the brackets 24 and 25 and into the floating screed bars 26 and 29, allows for looseness in this bracketed screed plate system which augments the vibratory action of the screed plate assembly.

The handle 33 attaches bilaterally to the floating screed plate assembly via the button handle socket brackets discussed above, and consists of button extension handle lengths 33. These lengths may be modified by the user. A desired length may be cut with consideration to the operator's height and comfort. The angle of the screed handle can also be adjusted at the level of standard bull float bracket. At the operator-end of the screed, the button handles attach to right and left 90° angle button handle fittings 14 which ultimately attach to a button handle width bar 23 which links the right and left button-handle length bars.

The screed bars are two laterally positioned rectangular 2"×4" dimensioned lengths of rigid material. Here again, the operator has a preferential choice: wood, magnesium, aluminum, steel, etc.

The user can modify the lengths of the screed bars 26 and 29 to fit the job's requirements. Lengths greater than 6' would require stabilization plate brackets on the outer right and left ends of the screed bars.

Figure 2:
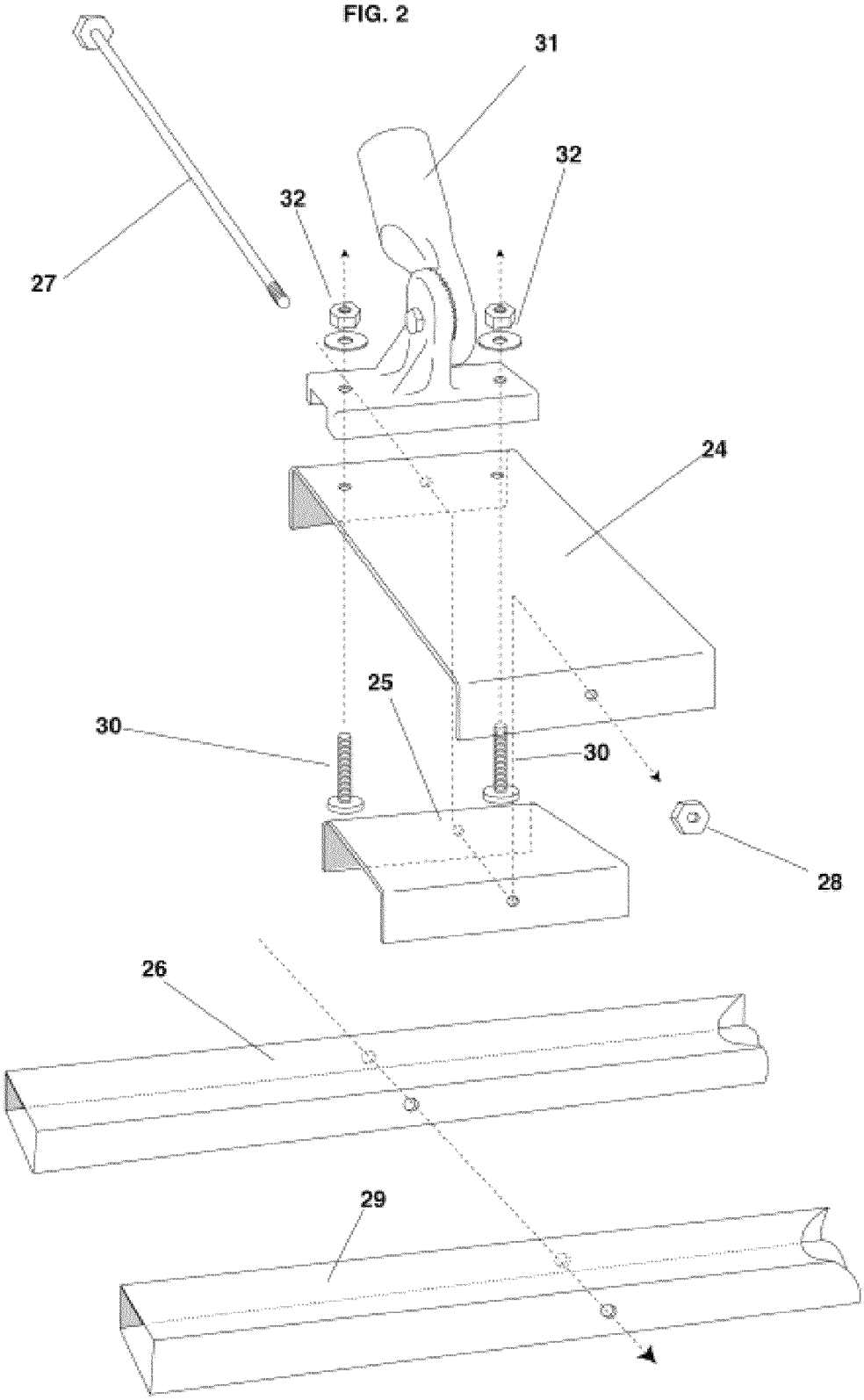
FIG. 2 is an perspective view of the bracket assembly of the present invention according to the presently preferred embodiment shown in FIG. 1.

FIG. 2 is an exploded view of the floating screed plate assembly from the user's right side showing the method of attachment. A standard bull-float bracket 31 readily available from concrete supply resources, is attached to the top bracket 24 of the assembly by two flat-head or countersunk bolts 30 which pass through the underside of the bracket through the holes in the bull-float bracket and are secured by washers and nuts. The remaining elements of the assembly are held together by passing a 14" bolt 27 in sequence, through a hole in the middle of the rear flange of the upper bracket 24, a hole in the front flange of the bottom bracket 25, holes in the forward floating screed bar 6, the front flange of the bottom bracket 25, (the bottom bracket, of which separates the two strike bars) the following screed bar 29, and finally, the rear flange of the upper bracket 35. A nut 28 secures the 14-inch bolt.

Figure 3A:
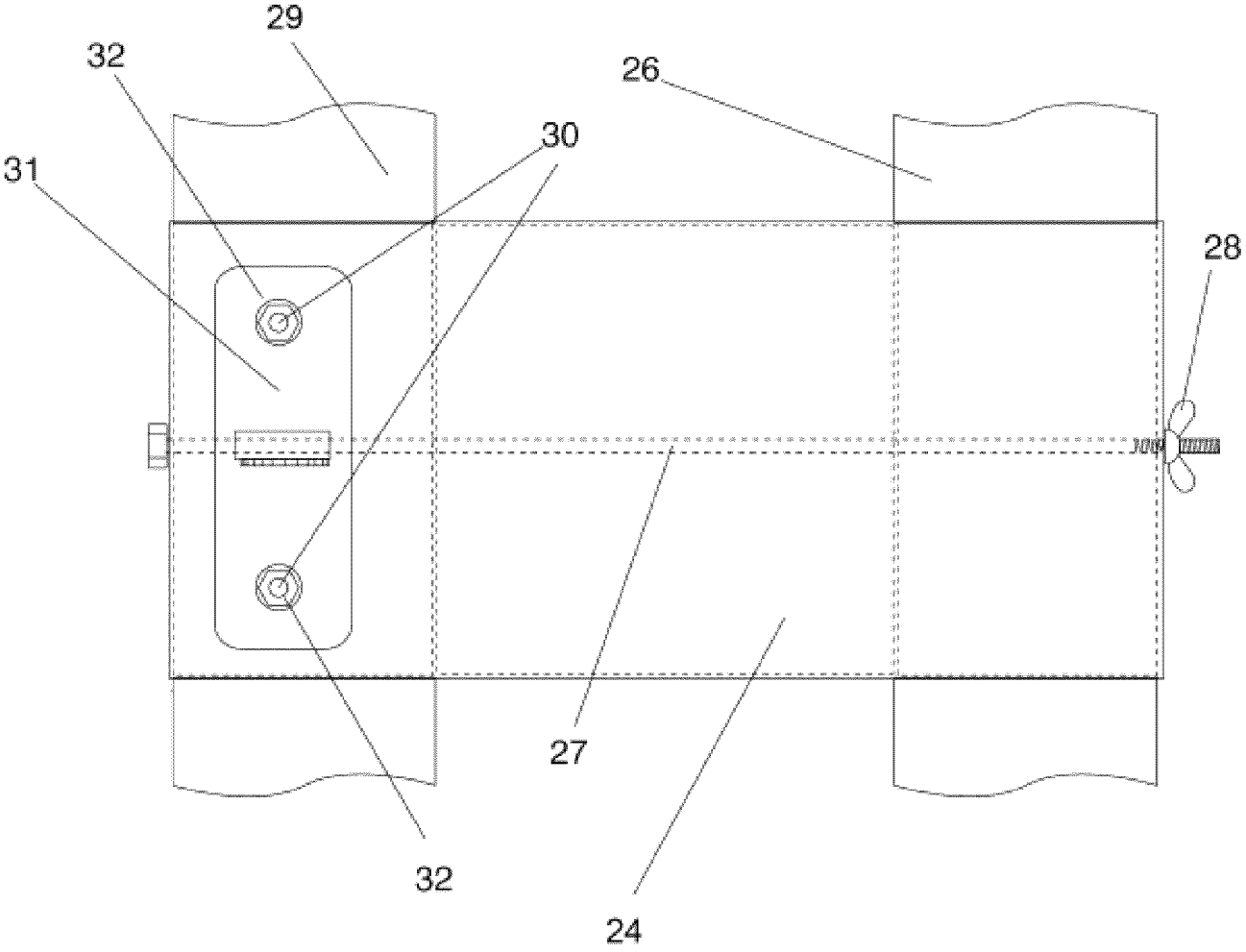
FIG. 3A is a top view of the assembled bracket assembly and related components of the invention according to the embodiment shown in FIGS. 1 and 2.
Figure 3B:
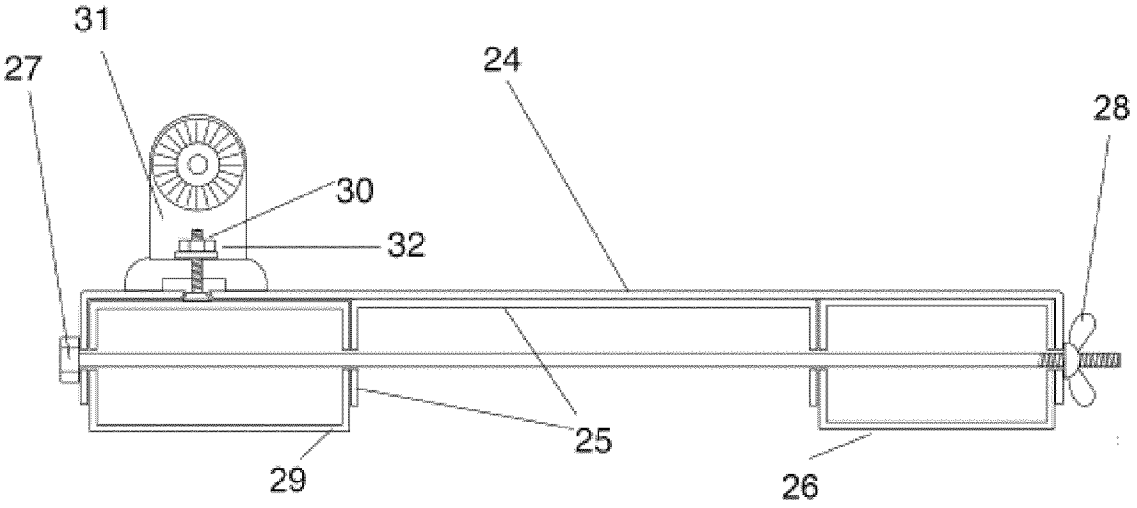
FIG. 3B is a side elevation view of the assembled bracket assembly and related components of the invention according to the embodiment shown in FIGS. 1 and 2.
Figure 3C:
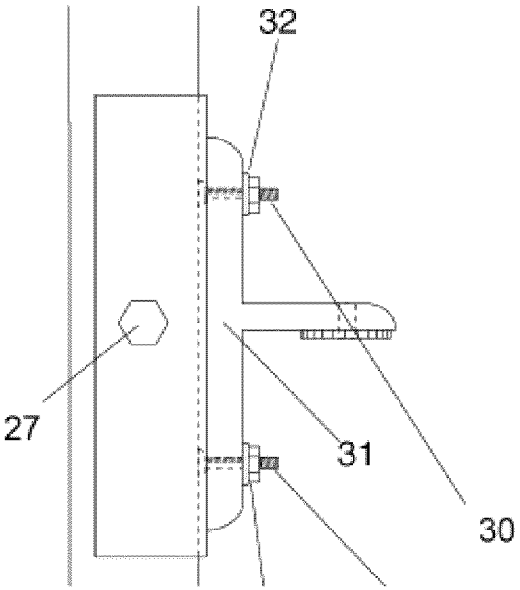
FIG. 3C is a front view of the assembled bracket assembly and related components of the invention according to the embodiment shown in FIGS. 1 and 2.

FIGS. 3A-3C are engineering drawings showing the top view (FIG. 3A), side elevation cross section (FIG. 3B), and front view (FIG. 3C) of an assembled bracket assembly and the assorted components of this embodiment. The top bracket of the screed assembly 24 is traversed by a 14" bolt 27 which runs through centered holes in its front and rear flanges. The top bracket has a standard bull-float bracket 31, attached by two flat-headed or countersunk bolts 30 which are secured by washers and nuts 32 to the top side of the standard bull-float bracket. The 14" bolt also holds the leading 29 and following 26 strike bars, which are separated by the lower portion of the bracket assembly 25. The 14" bolt is secured on the front flange of the upper bracket by a nut 28.

In operation, the operator stands in the fresh concrete. The screed is placed with the strike plate assembly on a "bench" of some sort which is "level"—either on a "form" or "wet bench". It is assumed that concrete has already been spread through the area to be screeded by means of laborers using concrete come-alongs or rakes. The operator walks backward using short, repetitive pulls, maintaining a level position of the strike plate assembly until the entire surface of the concrete has been struck. The surface of the concrete is now ready for final finishing. When pulled over an evenly distributed pour of concrete using a wet bench or dry form on one or both edges, this tool produces a smooth, level, struck-off concrete surface. The operator, in a standing position, grips a U-shaped handle, and, walking backward, contributes effective, low frequency, manual vibration as the screed is worked in a pulling motion over the concrete.

This embodiment allows its user-easy, quick assembly, disassembly, cleanup, virtually no-maintenance and convenient storage at a low cost. It produces a high quality, concrete slab product. Its ergonomic design, which utilizes the operator's whole body, does not stress single muscle groups or force the body into awkward positions while making repetitive motions where injury can occur.

The present invention is a novel, low-cost, essential concrete flatwork tool that provides the concrete contractor with the ability to perform high-quality flatwork with less labor, improved on-the-job safety, ease of use and simplicity.

Although the description above contains many specifics, these should not be construed as limiting the scope of the embodiments but as merely providing illustrations of some of the presently preferred embodiments. For example, when the size of the concrete pour necessitates extending the length of the screed bars to increase the length of the screed plate assembly to cover more footage, the U-shaped handle may be modified. Separate handles or multiple U-shaped handles may be attached at the screed plate assembly brackets and operated by a team to pull the screed over the concrete.

Motorized vibration may be added to this embodiment if the operator should desire to do so, attaching a vibratory mechanism to the screed in the manner dictated by the operation of the vibratory mechanism.

The width between screed bars in the screed plate assembly may be increased or decreased and is only limited by the size and or preference of materials available. If the width of the screed plate assembly desired is greater than six to eight feet, stabilization bracket assemblies are required to avoid flexing of the screed bars. These stabilization brackets are identical to the bracket assemblies in the original embodiment described earlier, but do not contain bolt holes for the button handle socket brackets. These brackets would be attached to the floating screed plate assembly identically to the above-described attachment means within first embodiment on the far right and far left of the screed plate assembly.

Multiple users can pull the screed over the concrete surface each using a handle. Across all embodiments, this tool is intended as a concrete screeding tool, but may be utilized to vibrate and level any type of plastic or granular material intended to cover a planar area.

Thus the scope of the embodiments should be determined by the appended claims and their legal equivalents rather than by the examples given.

I claim:

1. A non-motorized vibratory concrete leveling device comprising:

a bracket assembly having an upper surface and a lower surface, said lower surface of the bracket assembly having a plurality of spaced apart slots, each spaced apart slot extending across a width of said bracket assembly;

a plurality of screed bars corresponding to and positioned in said plurality of spaced apart slots such that said screed bars are positioned substantially parallel to one another;

means for promoting vibratory action in said plurality of screed bars during use; and an elongated handle having a first end attached to said bracket assembly and a second end for grasping by a user.

2. The non-motorized vibratory concrete leveling device according to claim 1, wherein the width of each of the plurality of spaced apart slots is greater than the width of each of the corresponding plurality of screed bars.

3. The non-motorized vibratory concrete leveling device according to claim 1, further comprising means for adjusting the fit of each of the screed bars in the corresponding slot.

4. The non-motorized vibratory concrete leveling device according to claim 3, further comprising means for removably securing each of the plurality of screed bars in the corresponding plurality of slots.

5. The non-motorized vibratory concrete leveling device according to claim 4, wherein said means for adjusting the fit and said means for removably securing comprises a fastener which passes through aligned openings in each of the plurality of screed bars and in aligned openings in the bracket assembly.

6. The non-motorized vibratory concrete leveling device according to claim 5, wherein the fastener is a bolt having a head on a first end thereof and a threaded portion extending from a second end thereof for receiving a nut thereon.

7. The non-motorized vibratory concrete leveling device according to claim 1, wherein the bracket assembly further comprises:

an upper bracket comprising a substantially flat, planar member with a leading edge flange extending downwardly from a first end thereof and a following edge flange extending downwardly from a second end thereof; and a lower bracket comprising a substantially flat, planar member with a leading edge flange extending downwardly from a first end thereof and a following edge flange extending downwardly from a second end thereof, said lower bracket having a width that is less then a width of the upper bracket, and said lower bracket positioned between the leading edge flange and following edge flange of said upper bracket such that a first one of said plurality of slots is defined by the leading edge flange of the upper bracket and the leading edge flange of the lower bracket, and a second one of said plurality of slots is defined by the following edge flange of the upper bracket and the following edge flange of the lower bracket.

8. The non-motorized vibratory concrete leveling device according to claim 7, wherein each one of the upper bracket leading edge flange, lower bracket leading edge flange, lower bracket following edge flange and upper bracket leading edge flange include a hole therein, each hole in each respective flange being in alignment with the holes in the other flanges; each of said screed bars further including a hole therein, which, when the screed bars are properly positioned in the slots, are in alignment with the openings in the respective flanges; said device further including an elongated fastener extending through the holes in said flanges and the holes in said screed bars for removably securing the screed bars to the bracket assembly.

9. The non-motorized vibratory concrete leveling device according to claim 8, wherein the elongated fastener comprises:

a bolt having a head at a first end thereof, a length extending through said holes in said flanges and said screed bars, and a threaded portion along the length proximal to a second end thereof; and a nut threadably engaging the threaded second end of said bolt.

10. The non-motorized vibratory concrete leveling device according to claim 9, wherein the head of said bolt engages the upper bracket leading edge flange at the hole therein, and when threaded into position, the nut releasably engages the upper bracket following edge flange at the hole therein.

11. The non-motorized vibratory concrete leveling device according to claim 10, wherein the fit of each of the screed bars in the corresponding slot is adjusted by tightening the nut on the bolt.

12. The non-motorized vibratory concrete leveling device according to claim 1, further comprising a bull-float bracket mounted on an upper surface of the bracket assembly, said first end of the elongated handle connected to the bull-float bracket.

13. The non-motorized vibratory concrete leveling device according to claim 1, further comprising a second bracket assembly having an upper surface and a lower surface, said lower surface of the second bracket assembly having a plurality of spaced apart slots, each spaced apart slot extending across a width of said bracket assembly for receiving a corresponding one of said plurality of screed bars.

14. The non-motorized vibratory concrete leveling device according to claim 13, further comprising a first bull-float bracket mounted on an upper surface of the first bracket assembly, and a second bull-float bracket mounted on an upper surface of the second bracket assembly.

15. The non-motorized vibratory concrete leveling device according to claim 14, wherein said elongated handle is a u-shaped handle having a first end connected to said first bull-float bracket and a second end connected to said second bull-float bracket.

16. The non-motorized vibratory concrete leveling device according to claim 15, wherein said u-shaped handle is comprised of a plurality of segmented tubing section that can be assembled to form the u-shaped handle.

* * * * *